US006032706A

United States Patent [19]

Lear

[11] Patent Number: 6,032,706

[45] Date of Patent: Mar. 7, 2000

[54] WOODWORKING JIG

[76] Inventor: Kevan F. Lear, #187, 1027 Davie Street, Vancouver, Canada, V6E 4L2

[21] Appl. No.: 09/247,579

[22] Filed: Feb. 10, 1999

[51] Int. Cl.[7] ..... B27F 1/14; B27M 3/00

[52] U.S. Cl. ..... 144/144.51; 144/144.1; 144/372; 409/130

[58] Field of Search ..... 33/197, 562, 565; 144/137, 144.1, 144.51, 144.52, 82–84, 371, 372; 409/125, 130, 178, 181, 182

[56] References Cited

U.S. PATENT DOCUMENTS 4,428,408 1/1984 Grisley ..... 144/144.51
4,603,717 8/1986 Thomas ..... 144/144.52
5,711,356 1/1998 Grisley ..... 144/144.52
5,832,977 11/1998 Hampton ..... 144/144.51

*Primary Examiner*—W. Donald Bray

[57] ABSTRACT

A woodworking jig has a pair of horizontally elongate co-planar router plate guide surface areas spaced apart from one another, with an elongate opening between the router plate guide surface areas, a workpiece clamp mounted below the opening, and a guide member support extending along the opening. Router guide members are releasably interengageable with the router guide to locate the router guide members in operative positions above the workpiece clamp and below the router plate guide surfaces.

33 Claims, 14 Drawing Sheets

WOODWORKING JIG

BACKGROUND OF THE INVENTION

1. Field of the Invention

The present invention relates to a woodworking jig and, more particularly, to a jig for use in making joints between pieces of wood, and is useful in particular, but not exclusively, for making dovetail joints.

2. Description of the Related Art

In prior art dovetail jigs, it has been common practice to provide a metal or phenolic template, or separate router guide fingers, mounted on top of the jig and serving to support the base plate of a router, while guiding a router bit projecting downwardly past the template or guide fingers. It is a disadvantage of such an arrangement that the template or guide fingers must be sufficiently rigid to support the downward pressure of the router base plate.

One prior art dovetail jig of that type has double-ended guide fingers, each with a male guide at one end and a female guide at the opposite end. If the fingers are uneven, the router tends to be deflected upwardly and downwardly during the cutting of the dovetail pins and tails, causing a step to be formed in the joint. The router is not supported beyond the ends of the fingers. In use, guide fingers are clamped onto guide rails and, to change from male to female guides, or vice versa, the guide rail, together with the guide fingers, must be removed from the jig, rotated and then reinstalled and repositioned on the jig for through dovetails or rotated end-to-end for half blind dovetails. Such an arrangement is complex and difficult to learn, and makes repeatability of the finger settings difficult to achieve. Furthermore, because the fingers are double-ended, and therefore long, the workpiece, which is horizontal, must be clamped relatively far from the end of the workpiece, which makes it difficult to clamp the workpiece rigidly.

It is also common, in prior art dovetail jigs, to clamp a horizontal workpiece down onto a top surface of a jig body and to clamp a vertical workpiece against a front surface of the jig body. When the workpieces have been thus clamped down onto or up against the jig body, the guide finger assembly has to be lowered down onto the top surfaces of the workpieces, adjusted into position and locked in place. This contributes to the complexity of such dovetail jigs and, also, adds to the manufacturing costs.

BRIEF SUMMARY OF THE INVENTION

According to the present invention, there is provided a woodworking jig which has a pair of horizontally co-planar, elongate router plate guide surface areas, spaced apart from one another by an elongate opening, a workpiece clamp mounted below the opening, a guide member support extending along the opening and a plurality of router guide members. The router guide and the router guide members are releasably interengageable to mount the guide members in operative positions above the workpiece clamp and below the router plate guide surfaces.

When this woodworking jig is in use, a vertically extending workpiece is clamped, at an upper end of the workpiece, with the upper end edge of the workpiece located below the opening. A router is then positioned above the jig, with a base plate of the router in sliding, guided engagement with the router plate guide surface areas and with a router bit projecting downwardly from the router into the opening, so as to be guided by the guide members mounted on the guide member support. The downward pressure of the router is thus supported by the router plate guide surface areas, and not by the guide members.

In a preferred embodiment of the invention, the guide member support comprises a row of locating formations which are interengageable with corresponding formations on the guide members. By spacing the locating formations in a uniform manner along the guide member support, the guide members can be easily located at various spacings apart from one another along the guide member support and these spacings can be readily restored when the guide members are removed from and subsequently reinstalled on the guide member support.

The guide members preferably comprise dovetail pin guides and dovetail tail guides which are separate from the dovetail pin guides, and may be readily engageable with the guide member support by snap-action engagement of the guide members onto the guide member support. However, the guide members may alternatively be shaped and utilized for cutting e.g. mortice and tenon joints, box joints, finger-joints and decorative joints.

BRIEF DESCRIPTION OF THE DRAWINGS

The present invention will be more readily understood from the following description of preferred embodiments thereof given, by way of example, with reference to the accompanying drawings, in which.

DESCRIPTION OF THE PREFERRED EMBODIMENT

Figure 1:
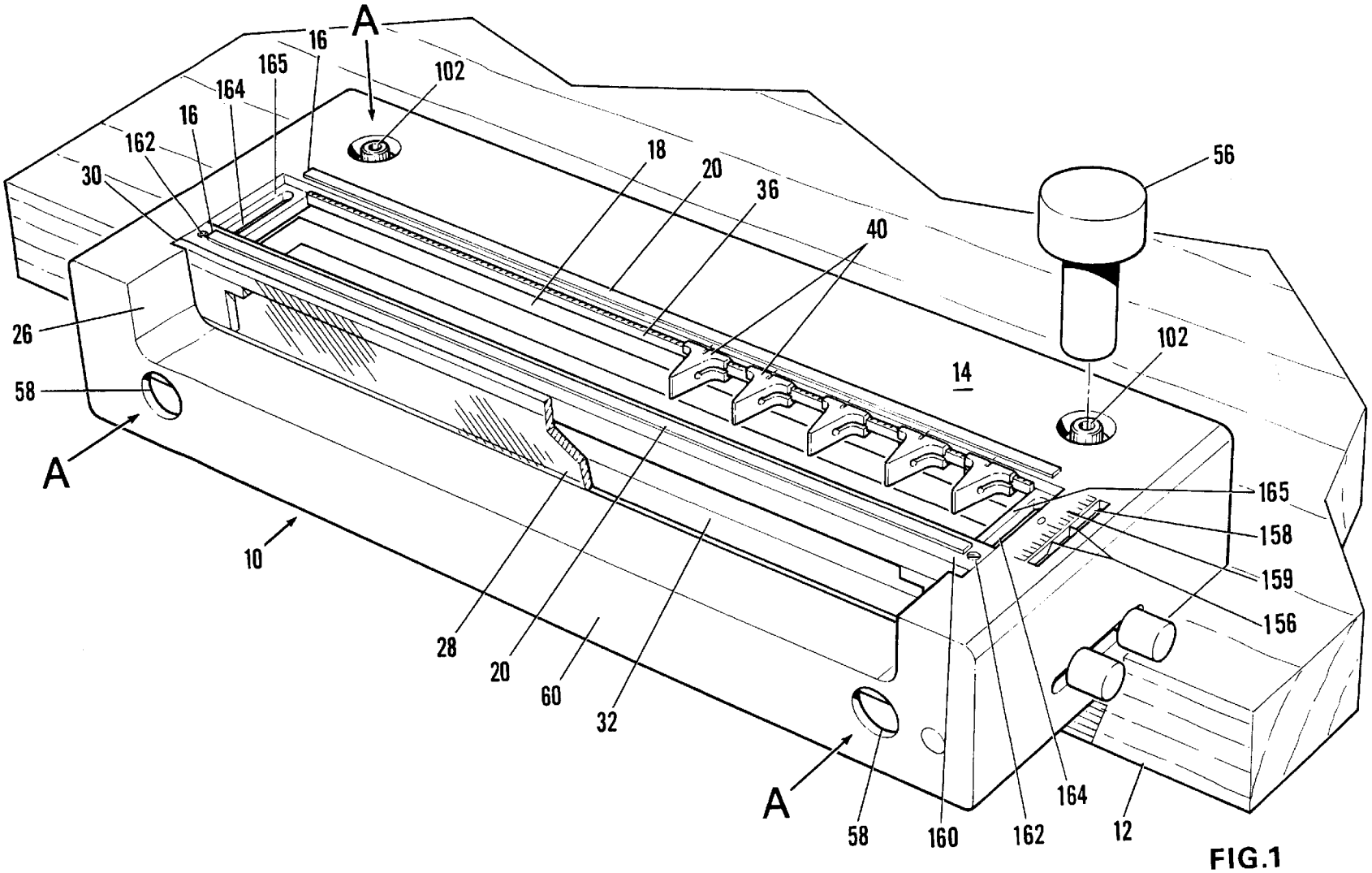
FIG. 1 shows an isometric view of a dovetail jig according to the present invention installed on a workbench.
Figure 2:
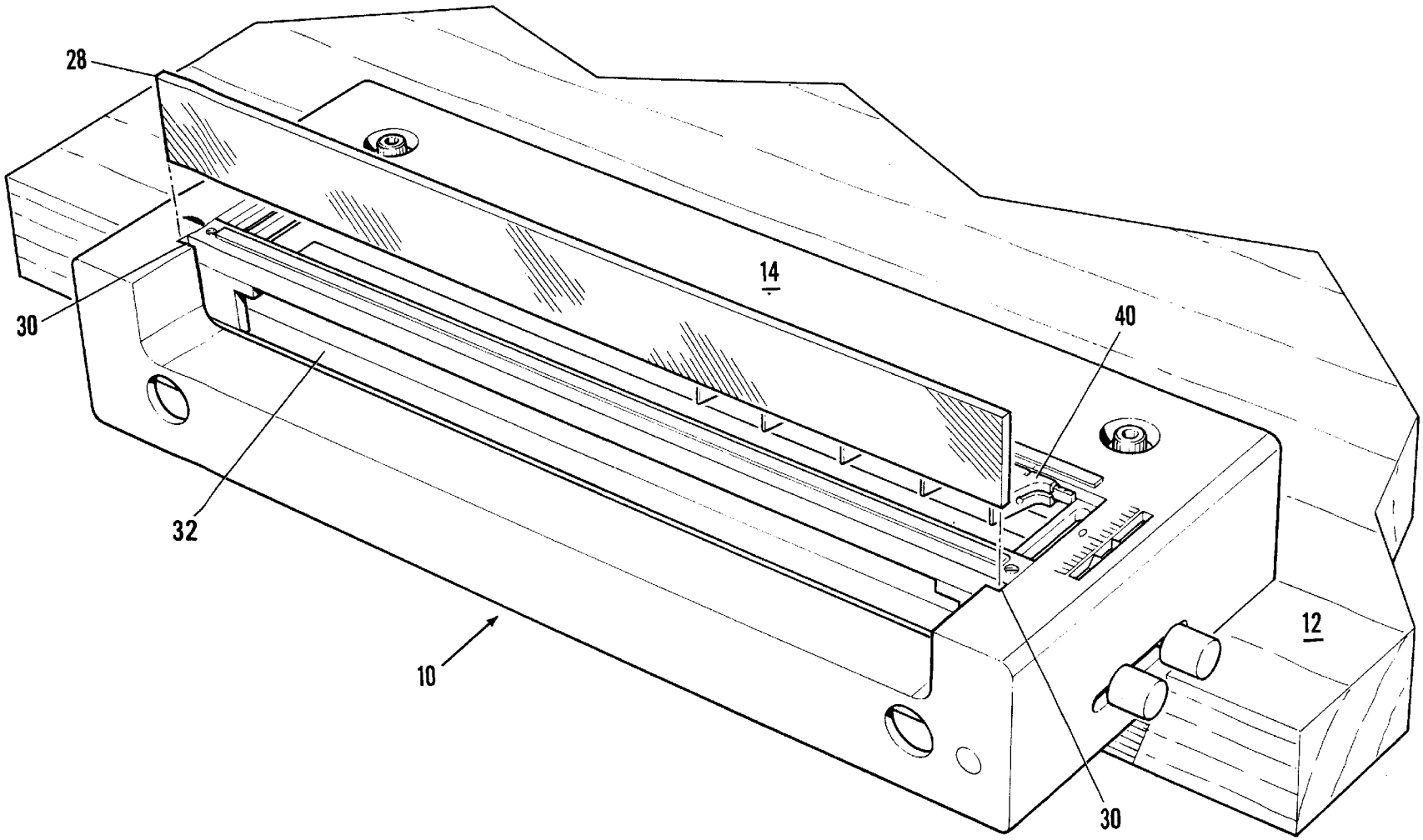
FIG. 2 shows a view corresponding to FIG. 1, but with parts of the jig removed.

In FIG. 1 of the accompanying drawings, there is shown a dovetail jig indicated generally by reference numeral 10 mounted on an edge of a workbench 12.

Figure 11:
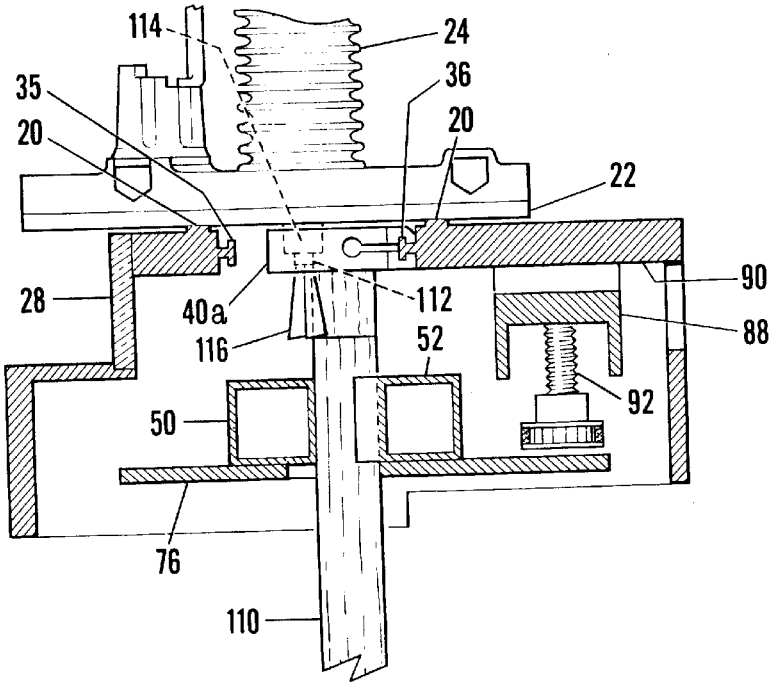
FIGS. 11 and 12 show views taken in vertical cross-section along the lines 11—11 of FIG. 9 and the lines 12—12 of FIG. 10, respectively, during the cutting operations of FIGS. 9 and 10, respectively.
Figure 12:
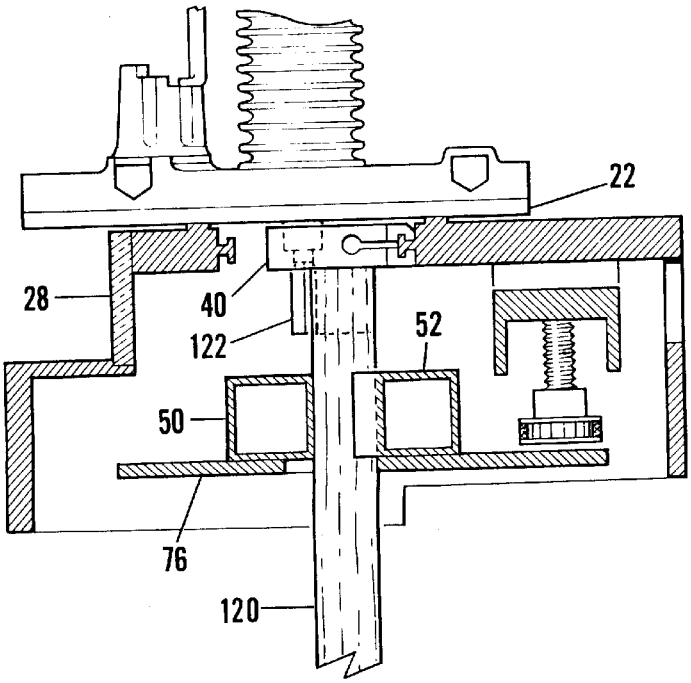

The dovetail jig 10 has a jig body in the form of a housing 14, formed as a casting, which is rectangular in plan view and which has, on its top, a router support comprising a pair of parallel, horizontally spaced raised top portions 16, which are elongate and straight and which extend along opposite sides of an horizontally elongate, rectangular, upwardly open top opening 18 between the raised portions 16. The raised portions 16 have flat, co-planar upper guide surfaces 20 which provide guide surface areas for slidably supporting and guiding a base plate 22 of a router 24, as shown in FIGS. 11 and 12. The raised portions 16 serve to raise the router base plate 22 above anyg7 dust or chips which may accumulate on the top of the housing 14.

At the front of the jig 10, a recess 26 is formed in the top of the housing 14, and at the rear of this recess 26 a vertical safety plate 28, made of glass, is inserted downwardly into a vertically open slot 30 in the housing 14, so that the safety plate 28 forms a closure for a front opening 32 in the housing 14.

In the top opening 18 of the housing 14, and extending along front and rear edges of the opening 18, there is provided a router bit guide arrangement comprising mutually opposed elongate guide member supports 35 and 36 (FIG. 11). As illustrated more clearly in FIGS. 7 and 8, the guide member support 36 is provided, along its length, with locating formations 38 in the form of serrations or teeth. More particularly, the guide member support 36 is in the form of a rail which has a horizontal T-shaped cross-section, with upper and lower flanges 36*a* and 36*b*, with the locating formations 38 formed in a linear row along the upper flange 36*a* of the guide member support 36 and facing rearwardly of the jig, and with the locating formations 38 being uniformly spaced along the guide member support 36. The guide member support 35 is similar to the guide member support 36.

FIG. 1 shows a plurality of dovetail pin guide members 40 mounted on the guide member support 36. The guide members 40, in the present embodiment of the invention, are made of plastic material, but they may alternatively be made of metal. One of these guide members 40 is shown in greater detail in FIG. 6, from which can be seen that this guide member 40 comprises a finger portion 42 which is partially bifurcated at one end to form opposed base portions 44*a* and 44*b*. The base portion 44*a* is provided with formations 46 in the form of teeth or serrations, which correspond to and are interengageable with the locating formations 38 on the guide member support 36.

Also, while in the present embodiment the guide members 40 and dovetail members 40*a* described below are shaped for the cutting of dovetail pins and tails, it will be apparent that they may be modified as other male and female guide members for the cutting of other types of joint.

Figure 7:
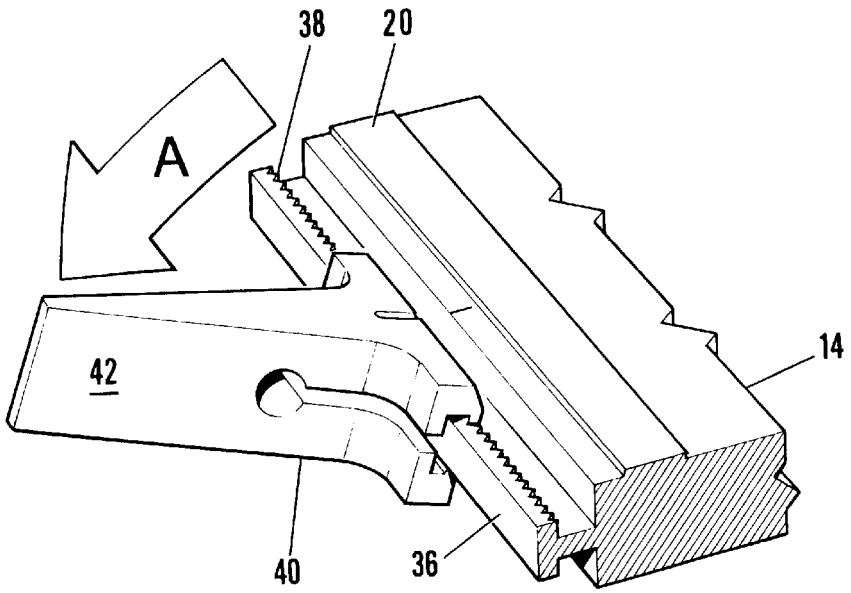
FIGS. 7 and 8 show successive steps in the interengagement of the dovetail pin guide of FIG. 6 with a guide member support on the jig of FIGS. 1 through 4.
Figure 8:
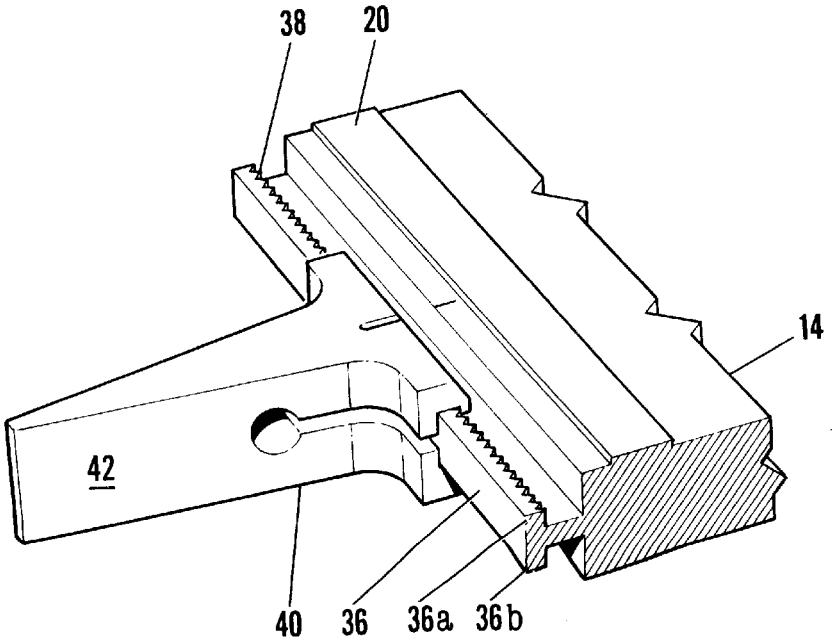

More particularly, as shown in FIG. 7, the guide member 40 is mounted on the guide member support 36 by firstly interengaging the base portion 44*a* with the locating formations 38 on the guide member support 36 and by then rotating the finger portion 42 downwardly as indicated by arrow A in FIG. 7, so as to engage the base portion 44*b* of the guide member, by a resilient snap-action interengagement, with the lower flange 36*b* of the guide member support 36. The guide member 40 is similarly mountable on the guide member support 35.

Figure 3:
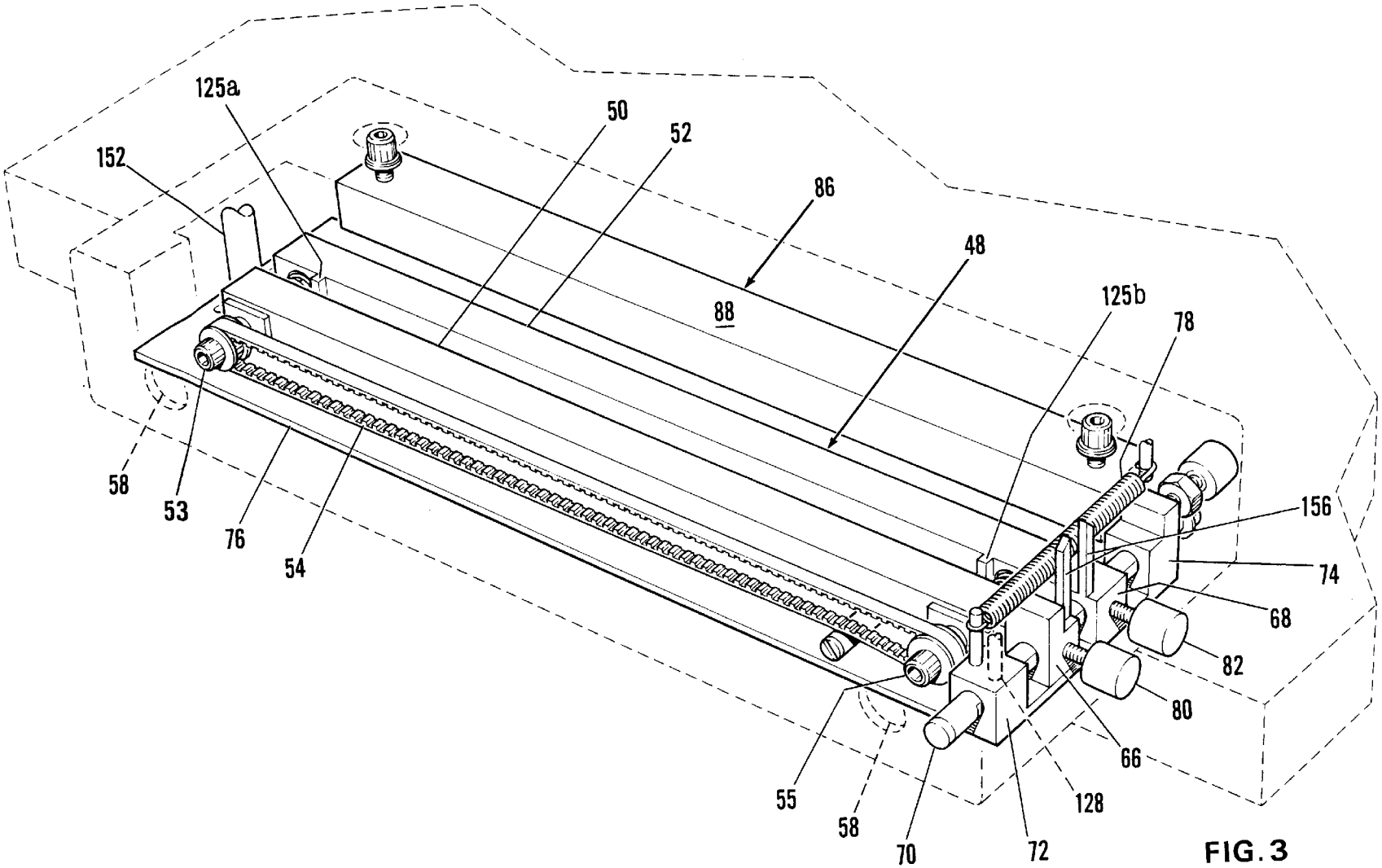
FIG. 3 shows a view corresponding FIGS. 1 and 2, but with further parts of the jig broken away to reveal components in the interior of the jig.
Figure 5:
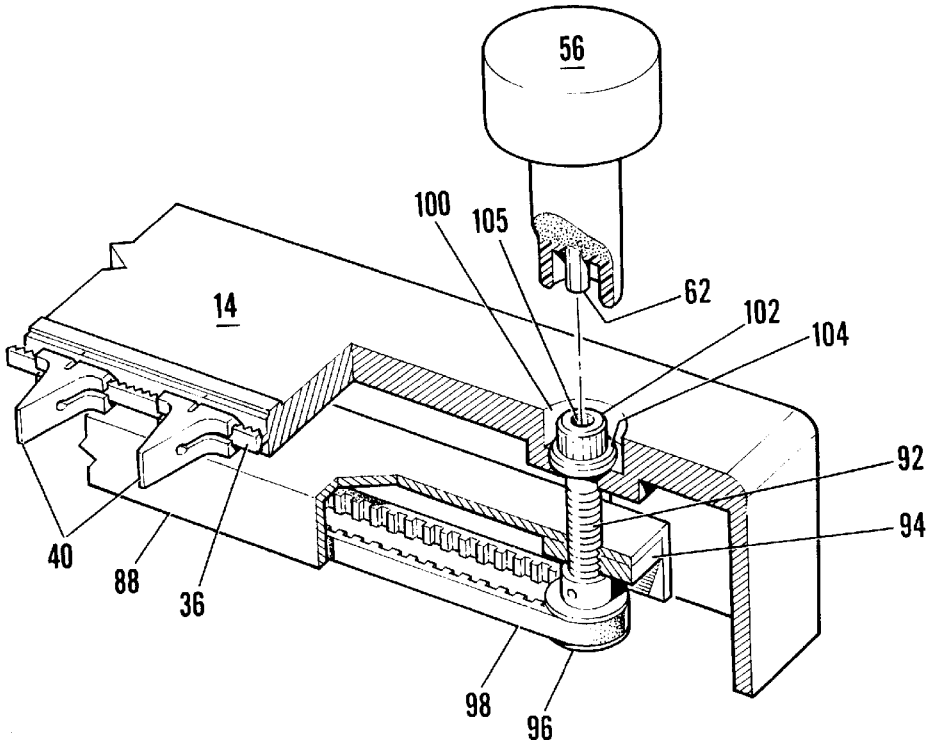
FIG. 5 shows a broken-away isometric view of parts of the jig of FIGS. 1 through 4.

Within the housing 14, as illustrated in FIG. 3, there is provided a clamping arrangement including a horizontally closable clamp 48, indicated generally by reference numeral 48, which comprises two clamp jaws in the form of clamp bars 50 and 52. To effect the horizontal closure and opening of this clamp 48, the clamp bars 50 and 52 are horizontally displaceable to and fro, relative to one another, by rotation of threaded shafts 53 and 55 provided at opposite ends of the clamp bars 50 and 52. The shafts 53 and 55 are interconnected by means of a belt and sprocket drive 54, which is provided with a belt tensioner 51, and are rotatable by insertion of an actuating knob 56, shown in FIG. 1 through vertical circular openings 58 in a front wall 60 of the housing 14. The knob 56 has a hexagonal pin 62 (FIG. 5) which is releasably engageable with a corresponding hexagonal end recess in each of the shafts 53 and 55, and in other shafts as indicated by arrows A, for rotating the shafts.

Figure 4:
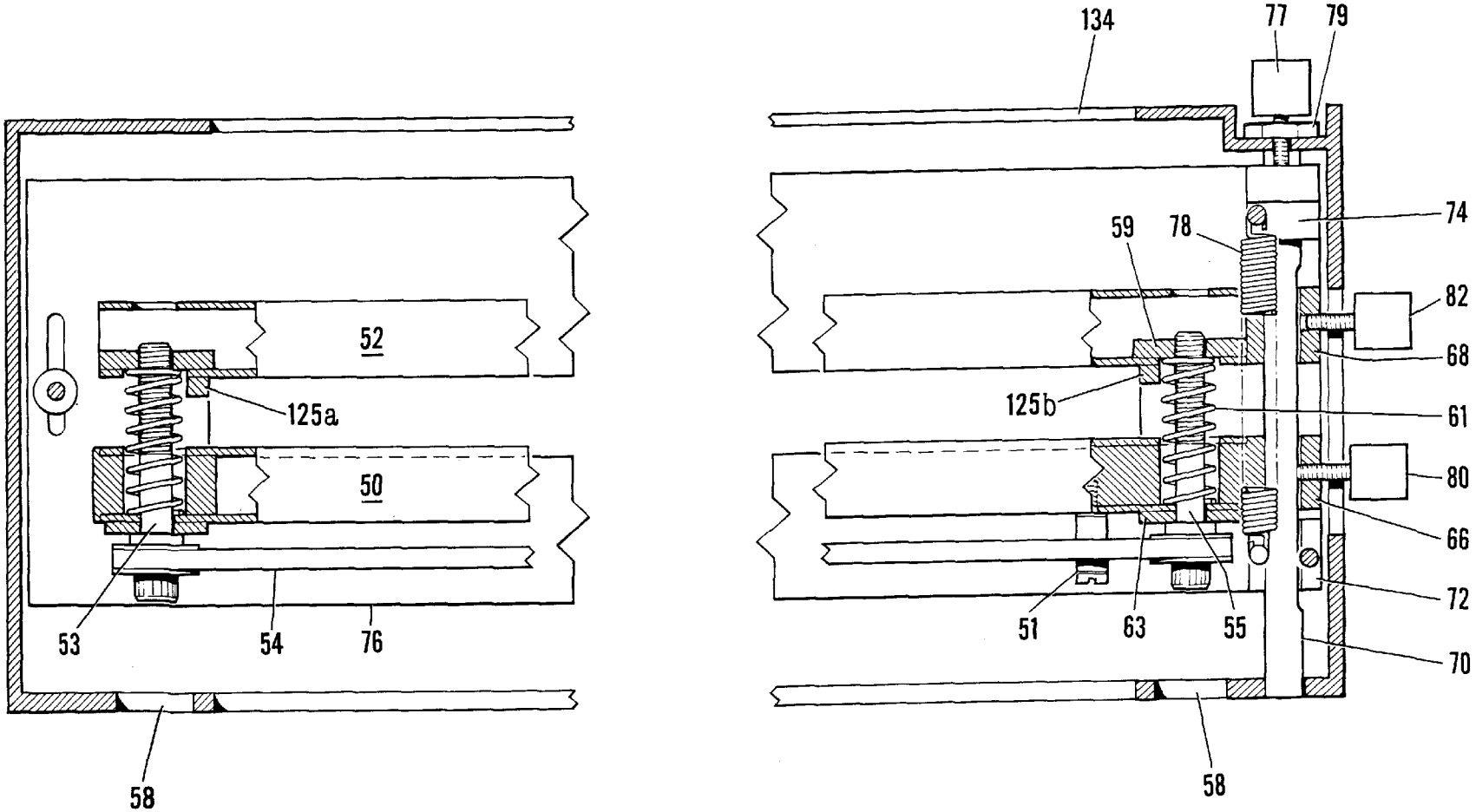
FIG. 4 shows a broken-away view taken in horizontal section through the jig of FIG. 3.

The clamp bars 50 and 52 are each made of sheet metal bent to form hollow bars of rectangular cross-section and plates 59 (FIG. 4) are secured to one interior wall of the clamp bar 52. The shafts 53 and 55 are in threaded engagement with the plates 59. Helical compression springs 61, which are co-axial with the shafts 53 and 55, are seated at opposite ends of the springs 61 on the plates 59 and on plates 63 which extend around the shafts 53 and 55 and are fixed to the exterior of the clamp bar 50, the shafts 53 and 55 being freely rotatable relative to the plates 63. Consequently, on rotation of the shafts 53 and 55, the clamp bars 50 and 52 are moved horizontally together against the action of the springs 61 or apart from one another, under the action of the springs 61, depending on the direction of rotation of the shafts 53 and 55.

The clamp bars 50 and 52 extend at one end to respective blocks 66 and 68 (FIG. 3), which are carried on a shaft 70 extending transversely of the lengths of the clamp bars 50 and 52. The shaft 70 is fixedly mounted at opposite ends thereof in the jig housing 14 and carries a pair of blocks 72 and 74, which are secured by screws (not shown) to a rectangular plate 76.

The plate 76, the blocks 68, 72 and 74 and the clamp bar 52 are thus fixed to one another to form an assembly which is slidable to and fro along the shaft 70. A helical tension spring 78, secured at opposite ends to the block 72 and the housing 14, resiliently biases the assembly towards the rear of the jig 10. An adjustment screw 77, provided with a lock nut 79, serves as an adjustable stop for this assembly, and the assembly can be manually displaced away from the stop against the action of the spring 78. Locking knobs 80 and 82, in threaded engagement with the blocks 66 and 68, respectively, can be tightened to releasably secure the clamp bars 50 and 52 one at a time to the shaft 70.

The clamping arrangement of the jig 10 also includes a vertically closable clamp indicated generally by reference numeral 86 in FIG. 3. The clamp 86 comprises a vertically movable clamp bar 88 co-operating with a downwardly facing clamp surface 90 (see FIG. 11) formed on the interior of the housing 14 at the rear of the jig 10.

The clamp bar 88 is suspended, at each end of the clamp bar 88, on a vertical threaded member 92. As shown in FIG.

5, which shows one of the threaded members 92, a threaded plate 94 provided within and fixed to the clamp bar 88 is in threaded engagement with the threaded member 92, the lower end of which carries a sprocket 96. A belt 98 interconnects the sprockets 96 on the two threaded members 92 and extends along and within the hollow interior of the clamp bar 88. The top of the housing 14 is formed with cylindrical recesses 100 for receiving heads 102 on the threaded members 92, which are also formed with annular flanges 104. The flanges 104 are rotatably slidably supported on the bottoms of the recesses 100 and the heads 102 are formed with hexagonal recesses 105 for receiving the hexagonal pin 62 to facilitate rotation of the threaded members 92 for raising and lowering the clamp bar 88.

The use of the jig 10 for cutting a through dovetail joint is illustrated in FIGS. 9 through 12.

Figure 9:
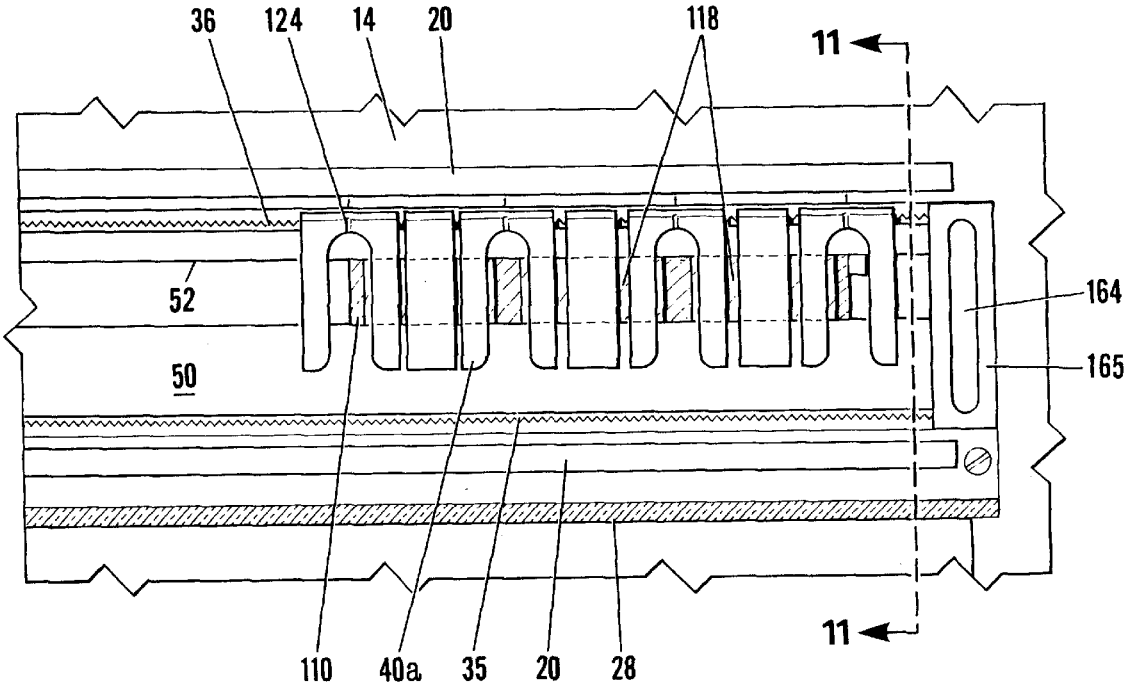
FIGS. 9 and 10 show broken-away plan views of parts of the jig of FIGS. 1 through 4 set up for cutting dovetail tails and dovetail pins, respectively, for a through dovetail joint.

In FIG. 9, tail guide members 40*a* are shown mounted on the guide member support 36, in a manner similar to the guide members 40, the tail guide members 40*a* being located at the required spacings from one another along the guide rail support 36. A vertically extending workpiece 110 is clamped between the horizontally closable clamp bars 50 and 52 and, as shown in FIG. 11, the workpiece abuts the undersides of the tail guide members 40*a* and also abuts one of the stops 125*a* and 125*b* (FIGS. 3 and 4) and the router 24 is positioned so that the router base plate is slidably supported on the guide surfaces 20 above the top of the housing 14. A dovetail router bit 112 is shown extending downwardly, with a slidable guide portion 114 of the router 24 engaging one of the tail guide members 40*a* and with a cutting portion 116 of the router bit 112 having cut through the thickness of the workpiece 110.

When the required tails 118 (FIG. 9) have been cut in this manner in the workpiece 110, the tail guide members 40*a* are disengaged from the guide member support 36 and the workpiece 110 is removed and replaced by another workpiece 120 (FIGS. 10 and 12), which is clamped between the clamp bars 50 and 52. The dovetail bit 112 in the router 24 is then replaced by a straight bit 122, and the tail guide members 40*a* are replaced by the pin guide members 40, as shown in FIG. 12.

During the cutting of the pins, the position of the plate 76 and thus the position of the clamp bar 52 are determined by adjustment of the adjustment screw 77 to correspondingly adjust the size of the pins.

Figure 10:
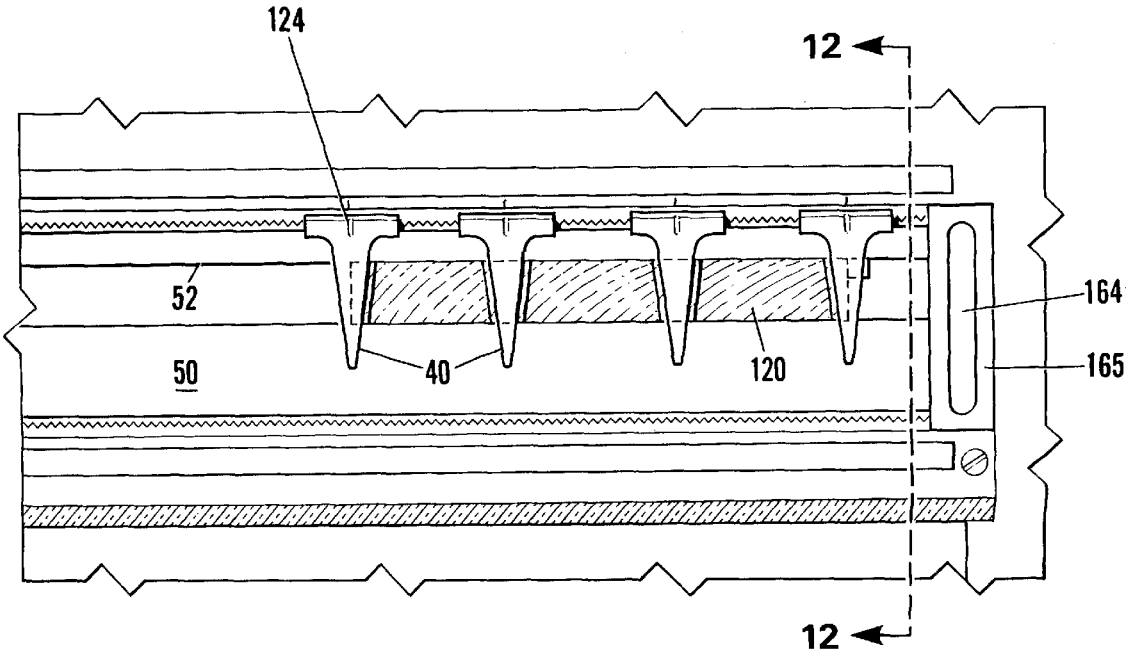

The tail guide members 40*a* and the pin guide members 40 are each formed with a position marker 124 (FIGS. 9 and 10). When the tail guide members 40*a* are mounted on the guide member support 36 as shown in FIG. 9, pencil markings may be inscribed on the jig housing, opposite the indicator markings 124. When the tail guide members 40*a* are then replaced by the pin guide members 40, the markings 124 on the pin guide members 40 can be aligned with these pencil markings in order to ensure correct positioning on the guide member support 36.

In each case, the workpieces 110 and 120 are located in abutment with one or the other of two stops 125*a* and 125*b* (FIGS. 3 and 4) on the jig.

FIGS. 13 through 16 show views corresponding to those of FIGS. 9 through 12, respectively, but with the jig being employed for the cutting of half blind dovetails instead of through dovetails.

Figure 15:
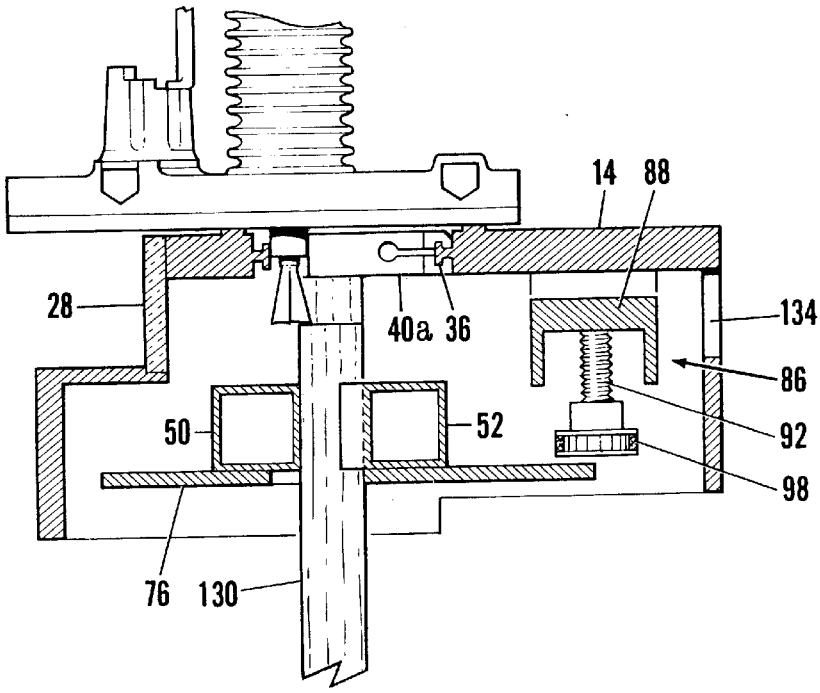
FIGS. 15 and 16 show views corresponding to FIGS. 11 and 12 and taken in vertical cross-section along the lines 15—15 and 16—16 of FIGS. 13 and 14, respectively, but during the cutting operations of FIGS. 13 and 14, respectively.

For this purpose, the plate 76 is displaced towards the front of the jig 10 through a distance sufficient to bring the block 66 into abutment with a stop 128 (FIG. 3) depending from the top of the housing 14 to thereby locate the clamp bar 50 in the position in which it is shown in FIG. 15 for the cutting of the tails.

Figure 13:
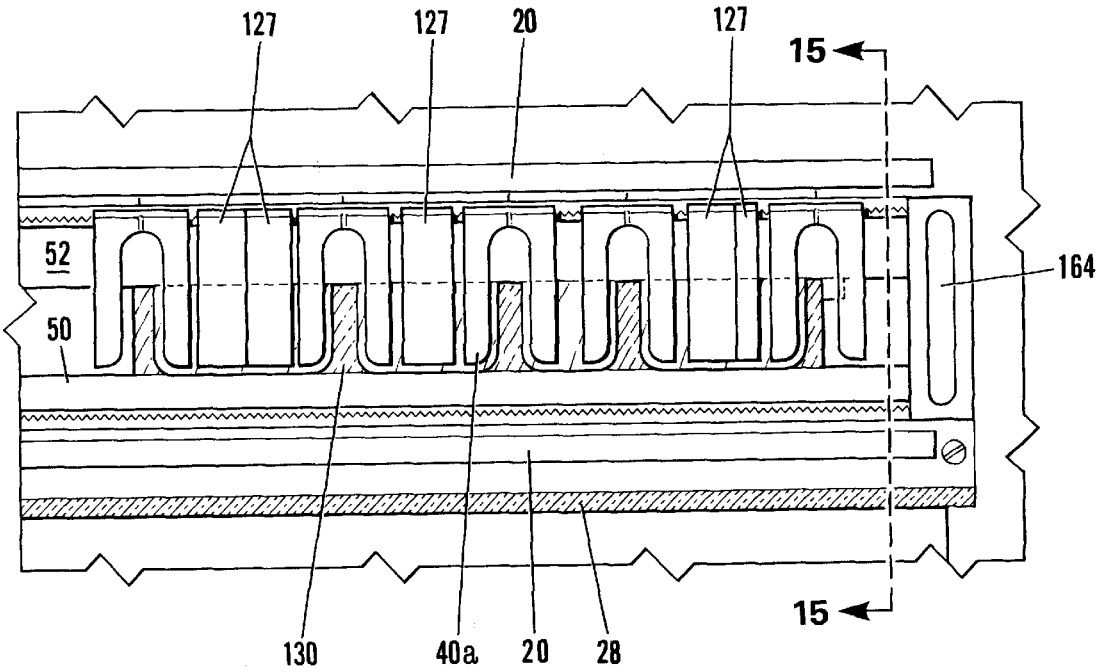
FIGS. 13 and 14 show views corresponding to FIGS. 9 and 10 but with the jig set up for a half-blind dovetail joint.

By adjusting the clamp bar 52 towards the clamp bar 50, a vertically extending workpiece 130 is then clamped in the horizontally closable clamp 48 and, as can be seen from FIG. 13, this workpiece 130 is then positioned correctly for the cutting of half blind tails instead of through tails.

As shown in FIG. 13, blocking members 127 are inserted between the tail guide members 40*a* to prevent the entry of the router bit between the tail guide members 40*a*. The blocking members 127 are secured to the guide member support 36 in the same manner as the tail guide members 40*a*.

Figure 14:
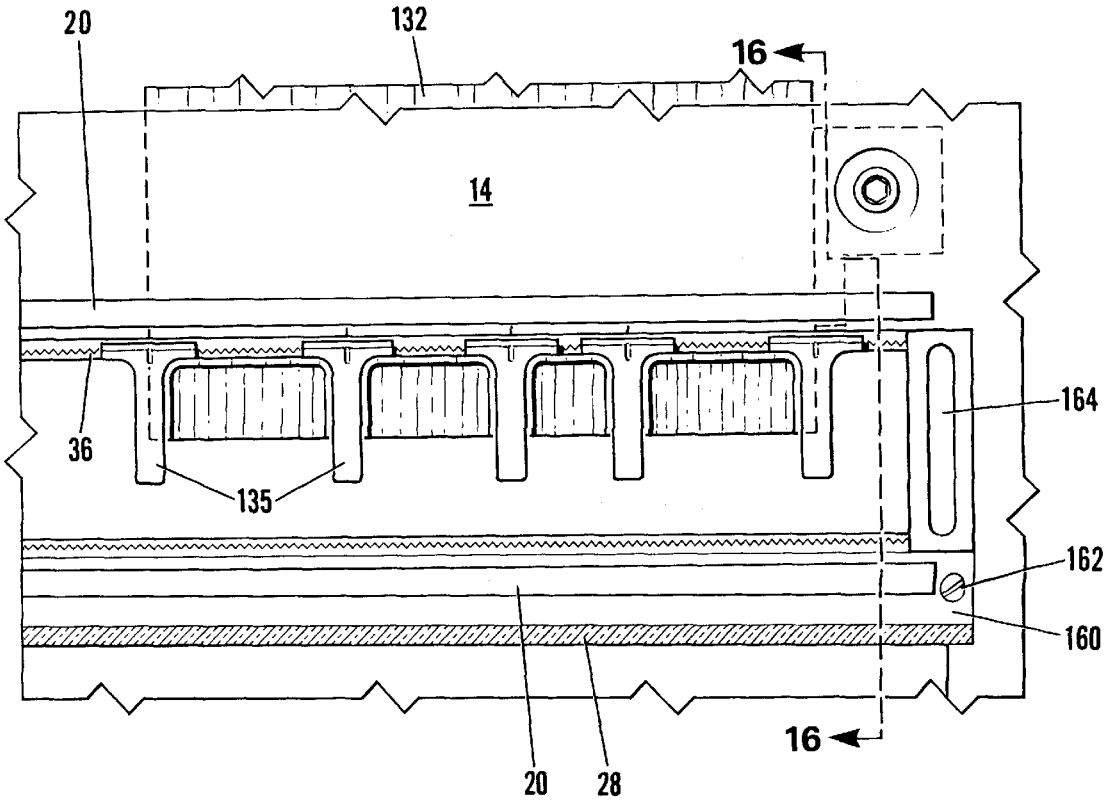
Figure 16:
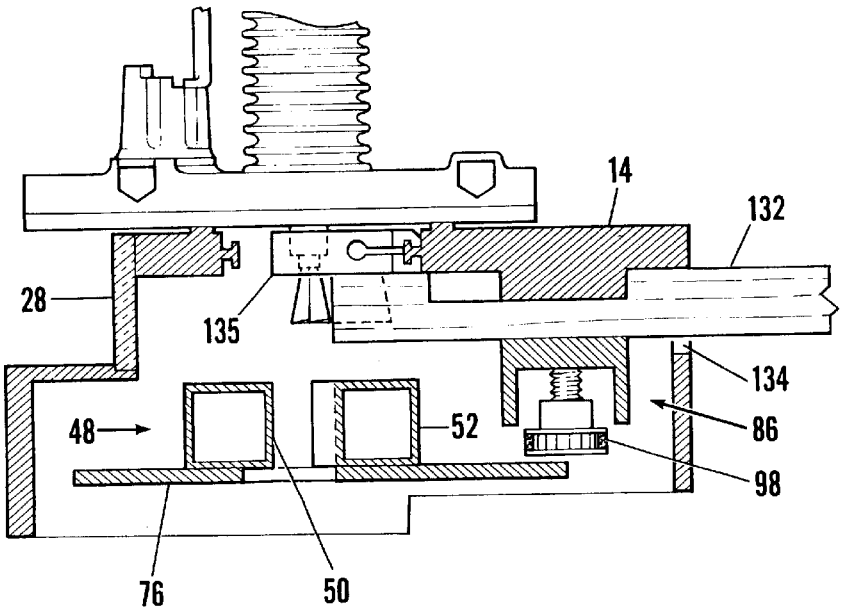

In order to enable the pins to be cut in this case, as illustrated in FIGS. 14 and 16, a horizontally extending workpiece 132 is inserted through an opening 134 in the rear of the jig housing 14 and secured by means of the vertically closable clamp 86, and pin guide members 135 are mounted on the guide member support 36.

By mounting one of the guide members 135 on the guide member support 35 and subsequently on the guide member support 36, the jig 10 may be employed to cut a tenon.

The depth of cut of the router bit during the cutting operations shown in FIGS. 15 and 16 determines the fit of the half-blind dovetails and pins.

The safety plate 28 may be removed to allow a workpiece to project to the front of the jig, 10, e.g. for cutting a mortice in the workpiece.

Figure 17:
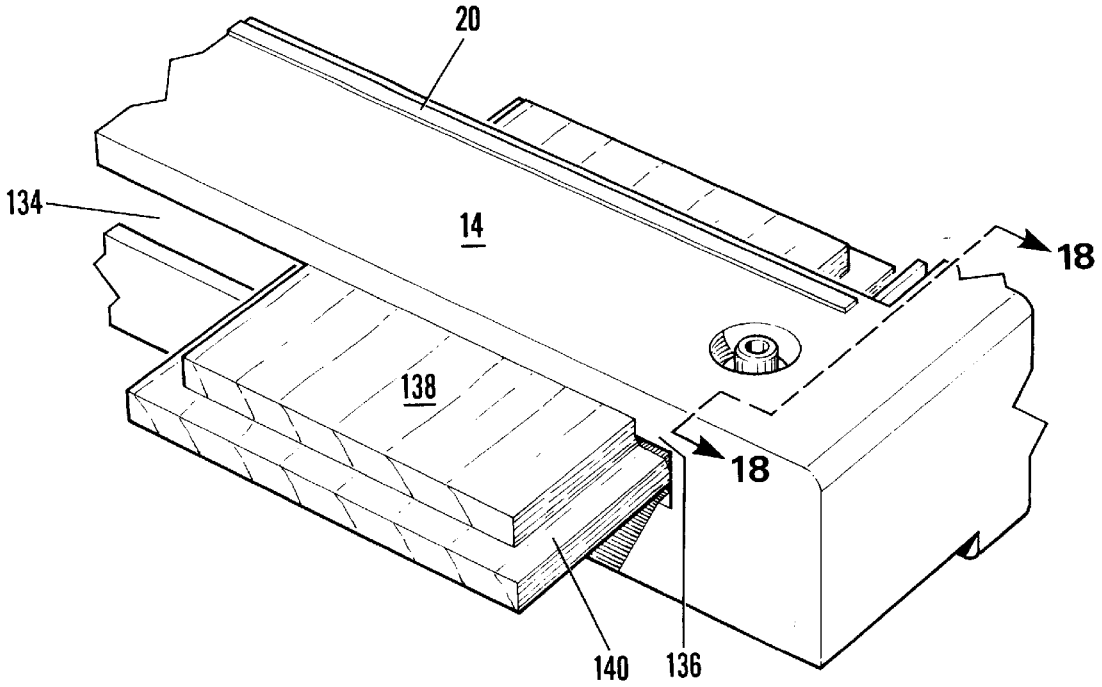
FIG. 17 shows a broken-away isometric view of parts of the jig of FIG. 1.

As shown in FIG. 17, the end of the opening 134 is formed with a shoulder 136, the purpose of which is to accommodate a workpiece 138 formed with a rabbet 140. It is to be noted that the shoulder 136 serves as a reference stop which determines the position of the workpiece during the cutting of the half-blind pins. Consequently, the pins are cut so as to be correctly aligned with the tails.

Figure 18:
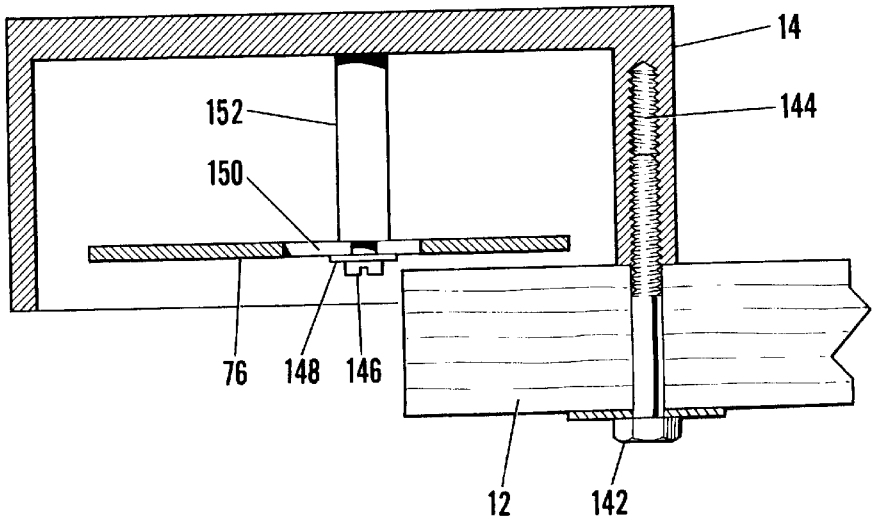
FIG. 18 shows a view in vertical cross-section along the line 18—18 of FIG. 17.

FIG. 18 shows a securing bolt 142 inserted through a boring in the workbench 12 into threaded engagement with a threaded hole 144 in the housing 14 for releasibly securing the housing 14 to the workbench 12.

FIG. 18 also shows a shouldered securing screw 146 which is inserted through a washer 148 and which abuts the plate 76 and extends through a slot 150 in the plate 76 into threaded engagement with a post 152 depending from housing 14 and serving to support the plate 76.

As shown in FIG. 3, the blocks 66 and 68 are provided with upstanding pointers 156, which project upwardly through a slot 158 (FIG. 1) in the top of the housing 14. A scale 159 on the top of the housing 14 adjacent the slot 158 can be used for centering the workpiece and to enable the clamp bar 52 to be readjusted back into a previous position, when required.

The raised portion 16 at the front of the jig 10 near the safety plate 28 is provided on a metal strip 160, which is releasibly secured to the jig housing 14 by screws 162. On removal of the strip 160, a rectangular template (not shown) can be secured to the jig housing 14 by bolts (not shown) engaged through slots 164 formed in ledges 165 at opposite ends of the opening 18 and secured by nuts (not shown). The template may be formed with a straight slot or slots of other shapes, e.g. in the form of letters or numbers or decorative shapes.

Figure 19:
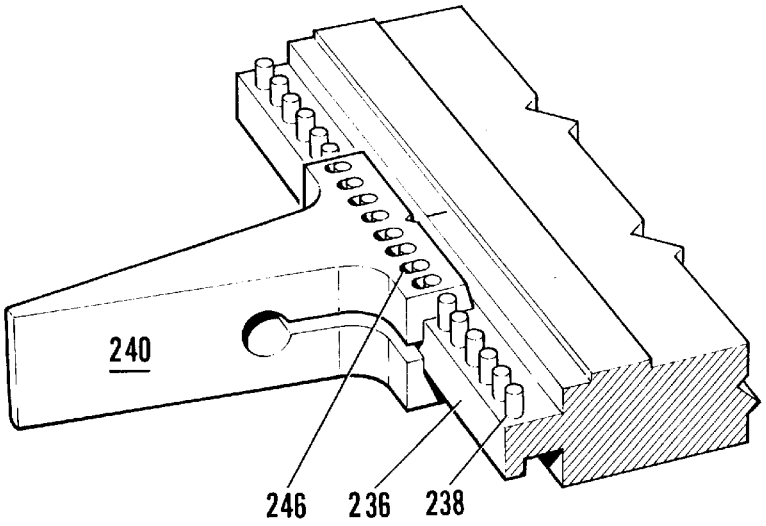
FIG. 19 shows a broken-away isometric view of a modified router bit guide arrangement for use in the jig of FIG. 1.

FIG. 19 shows a broken-away view, in perspective, of a modification of the router bit guide arrangement of the jig 10 of FIGS. 1 through 18.

In this modified router bit guide arrangement, the elongate guide member support 36 has been replaced by an elongate guide member support 236 which, instead of the T-shaped locating formations 38, is provided with vertically upwardly extending cylindrical projections 238, which are uniformly spaced apart from one another in a linear row along the top of the guide member support 236. The guide member support 35 has also been replaced by a modified guide member support (not shown) which is similar to the guide member support 236.

Figure 6:
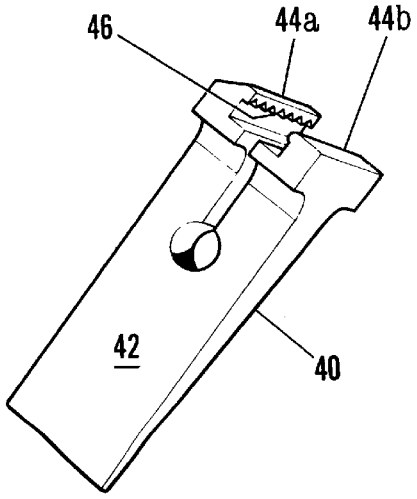
FIG. 6 shows an isometric view of a dovetail pin guide forming part of the jig of FIGS. 1 through 4.

The router guide member, which in this case is indicated by reference numeral 240, is similar to the guide member 40 shown in FIG. 6 but, instead of the teeth 46 of the guide member 40, is formed with a row of openings 246. These openings 246 are elongate and are dimensioned and spaced apart so as to be interengageable with the cylindrical projections 238, as shown in FIG. 19, for securing the guide member 240 to the guide member support 236.

As will be readily apparent to those skilled in the art, other types of interengageable locating formations may alternatively be provided on the guide members and the guide member support for releasibly securing the guide members to the guide member support.

The guide members 40 and 240, referred to above and illustrated in the drawings, are shaped to form conventional dovetail joints. However, as will also be readily apparent to those skilled in the art, the shapes of the guide members and, more particularly, the surfaces of the guide members used for guiding contact with the router may be modified to produce other, unconventional shapes such as the joints indicated generally by reference numeral 250 in FIG. 20A and reference numeral 252 in FIG. 20B.

The angle of the dovetails cut by the present jig can be varied in a very simple manner by replacing the guide members 40 or 240 by similar guide members having different angles.

Figure 20A:
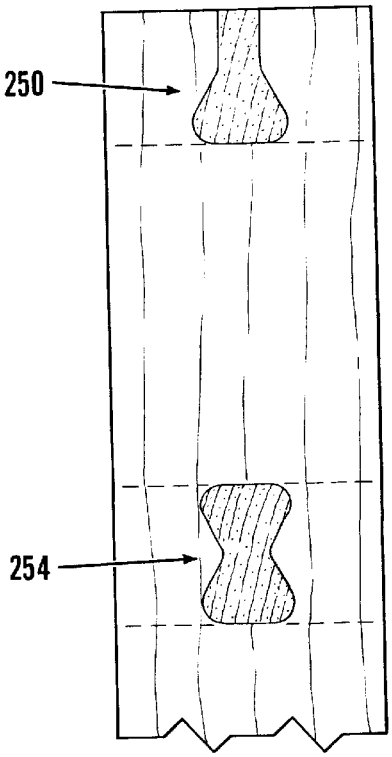
FIGS. 20A and 20B show diagrammatic views in front elevation of alternative joints which can be produced by a jig according to the present invention.
Figure 20B:
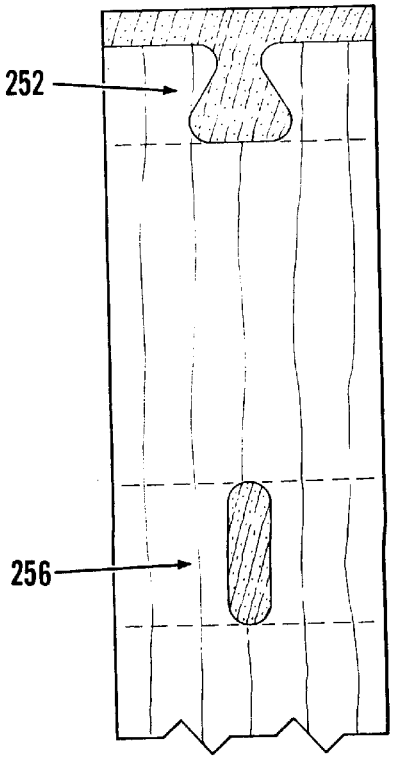

FIGS. 20A and 20B also show mortice and tenon joints, indicated generally by reference numerals 254 and 256, of unconventional shape, which can be cut employing the present woodworking jig.

Figure 21:
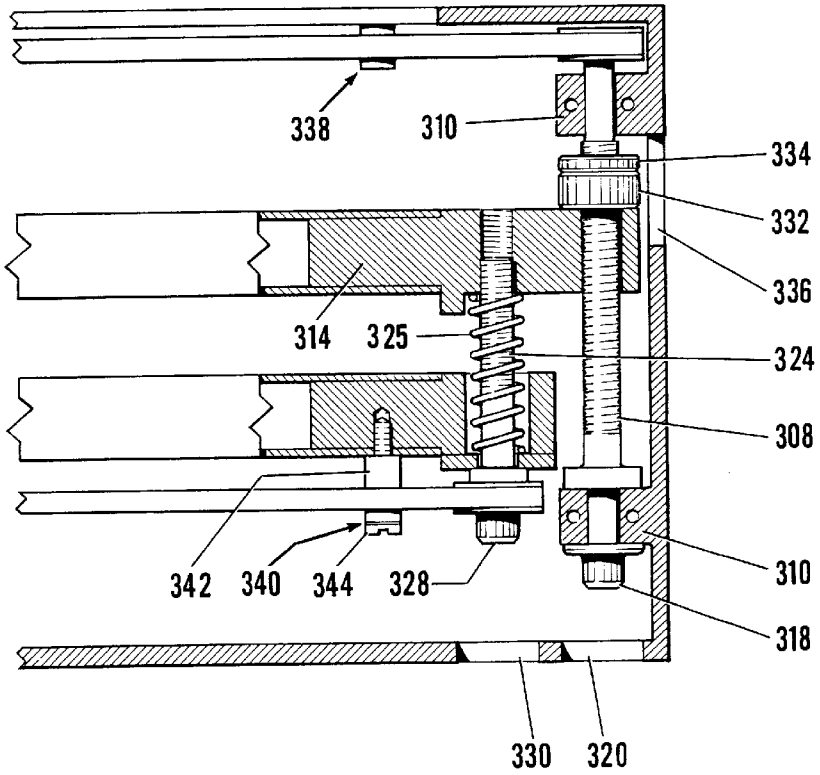
FIG. 21 shows a view taken in horizontal cross-section through a modification of the jig of FIG. 1.
Figure 21:
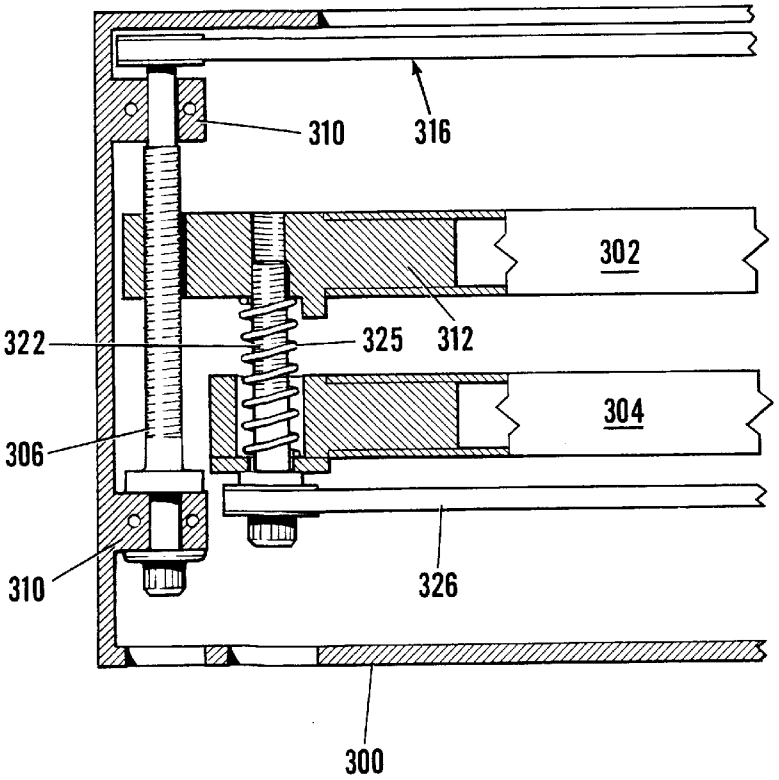

FIG. 21 shows a view in horizontal cross-section through a modification of the clamping arrangement of the jig of FIG. 1.

In FIG. 21, in which the jig housing is indicated by reference numeral 300, first and second clamp bars are indicated by reference numerals 302 and 304, respectively. The clamp bar 302 is supported, at opposite ends of the clamp bar 302, by a pair of threaded shafts 306 and 308 which are journalled in horizontally split bearings 310 on the housing 300. The threaded shafts 306 and 308 are in threaded engagement with opposite solid ends 312 and 314 of the clamp bar 302. A belt and sprocket transmission, indicated generally by reference numeral 316, interconnects the shafts 306 and 308, so that rotation of the shaft 308 will cause a corresponding rotation of the shaft 306. For this purpose, the shaft 308 is formed, at its end facing the front of the housing 300, with a socket 318, into which an actuating knob 56 can be inserted, through an opening 320 in the front of the housing 300. The shafts 306 and 308 and the belt and sprocket transmission 316 thus form an adjustment mechanism for adjustably displacing the clamp bar 302 horizontally to and fro.

The clamp bar 304 is connected to the clamp bar 302 by a connection which comprises a pair of threaded shafts 322 and 324, which are freely rotatably secured to the clamp bar 304 and which are in threaded engagement with the end members 312 and 314 of the clamp bar 302. Helical compression springs 325 on the shafts 322 and 324 bias the clamp bars 302 and 304 apart from one another. The shafts 322 and 324 are interconnected by a belt and sprocket transmission indicated generally by reference numeral 326, and the shaft 324, at its end facing the front of the housing 300, is formed with a socket 328, so that an actuating knob similar to the actuating knob 56 can be inserted through an opening 330 in the front of the housing 300 into engagement with the shaft 324 for rotating the shafts 322 and 324 and, thereby, moving the clamp bar 304 horizontally towards or away from the clamp bar 302.

For limiting the movement of the clamp bar 302 towards the rear of the housing, an adjustable stop in the form of a knurled threaded bush 332 and a knurled locking nut 334 are in threaded engagement with the shaft 308 and are manually accessible through a side opening 336 in the housing 300.

Belt tensioners, indicated generally by reference numerals 338 and 340 are secured to the rear wall of the housing 300 and to the clamp bar 304, respectively, and each comprise a replaceable cylindrical roller 342 on a screw 344, the roller 342 being in rolling engagement with the respective belt and being replaceable by a roller of larger diameter when necessary to tighten the belt.

It is to be understood that the clamping arrangement illustrated in FIG. 21 replaces that shown in FIG. 3 in a jig which is otherwise similar to that of FIG. 1 and which, therefore, includes a router support, on the top of the housing 300, which is similar to that described above with reference to the jig 10, a router bit guide arrangement similar to that described above with reference to FIGS. 1 through 18 or FIG. 19, and front and rear openings in the housing, similar to those described above with reference to the embodiment of FIGS. 1 through 18.

Figure 22:
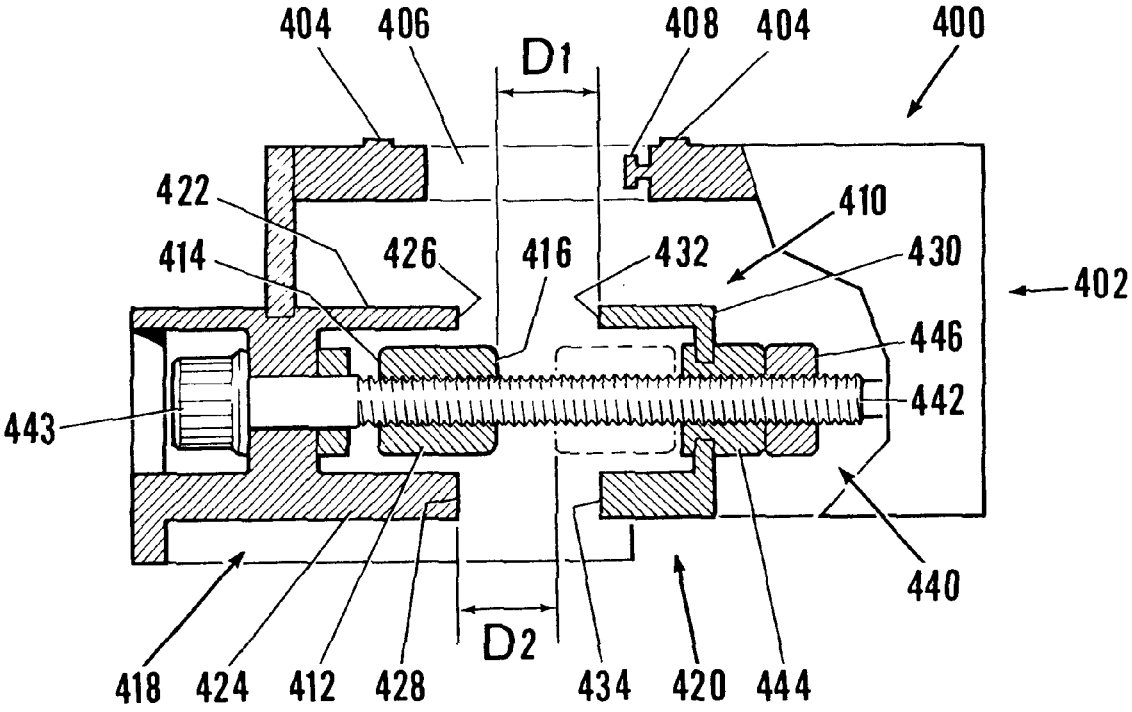
FIG. 22 shows a diagrammatic view in vertical cross-section through a further modified jig according to the present invention.

FIG. 22 shows, in a diagrammatic vertical cross-sectional view, a modification of the above-described jigs which is a simplified clamping jig, indicate generally by reference numeral 400, for use in cutting dovetail joints only.

In FIG. 22, the housing of the jig 400 is indicated generally by reference numeral 402 and, corresponding to the above-described jigs, has a router support comprising guide surfaces 404 provided on the top of the housing 402 around and above an opening 406, which is of elongate, rectangular shape and has, along one side of the opening, a guide member support 408 which is similar to the guide member supports 36 of FIGS. 1 through 18 and which, therefore, will not be described in greater detail.

The guide member support 408, together with guide members similar to the above-described guide members 40, form a router bit guide arrangement which is located between the router support and a clamping arrangement indicated generally by reference numeral 410.

The clamping arrangement 410 has an elongate clamp member in the form of a clamp bar 412, which has, on opposite sides of the clamp bar 412, first and second oppositely directed clamping surfaces 414 and 416.

The clamping arrangement 410 also includes a fixed first abutment, indicated generally by reference numeral 418 and an adjustable second abutment, indicated generally by reference numeral 420.

The first abutment 418 is formed by a pair of vertically spaced, horizontal flanges 422 and 424 on the housing 402, which are formed with co-planar first abutment surfaces 426 and 428.

The second abutment 420 comprises a U-shaped channel member 430 having a pair of vertical co-planar second abutment surfaces 432 and 434 facing towards the front of the housing 402.

The surfaces 426 and 428, and also the surfaces 432 and 434, are spaced apart vertically from one another by a distance sufficient to allow the clamping bar 412 to pass therebetween, so that the clamping bar 412 can be moved between a first operational position, in which it is located between the surfaces 426 and 428 and in which it is shown in full lines in FIG. 22, and a second operational position, in which it is located between the surfaces 432 and 434 and in which it is shown in broken lines in FIG. 22.

The second elongate abutment 420 is mounted for displacement towards and away from the first elongate abutment 418 by means of an adjustment device indicated generally by reference numeral 440 in FIG. 22. This adjustment device comprises a threaded shaft 442, which is rotatably adjustable by means of the adjustment knob 56, which is not shown in FIG. 22 but which engages a head 443 of the shaft 442. The shaft 442 is in threaded engagement with the clamping bar 412 and is provided with a stop in the form of a knurled threaded bush 444, which is rotatably engaged in the abutment 420, and a knurled lock nut 446.

In a first operational clamping position, the clamp bar 412 is spaced from the co-planar surfaces 432 and 434 by a distance D1 for clamping a workpiece during the cutting of through dovetail pins or through dovetail tails in the workpiece.

By adjusting the position of the channel member 430, by means of the threaded bush 444 and the lock nut 446, the thickness of the dovetail pins can be adjusted to fit the tails of the joint.

To clamp a workpiece for cutting half-blind tails, the clamping bar 412 is adjusted into a second operative or clamping position, shown in broken lines in FIG. 22, in which a workpiece can be clamped between the second clamping surface 414 and the first abutment surfaces 426 and 428, which are spaced apart by a distance D2.

It is an advantage of the above-described jigs according to the invention that, once the position of one of the horizontally closable clamp bars has been adjusted, workpieces of different thicknesses are accommodated by the horizontally closable clamp during the cutting of through dovetails and, therefore, there is no need for the users to subsequently readjust the jigs, as was necessary in prior art jigs.

Thus, in the embodiment of FIGS. 1 through 20B, when the adjustment screw 77 has once been adjusted and locked, no further adjustment is necessary. In the embodiments of FIGS. 21 and 22, the threaded bush 332 and the adjustment device 446 can each be adjusted once and subsequent readjustment is then not necessary.

Also, the jigs can be used to cut half-blind dovetails without readjustment to take into account different workpiece thicknesses.

Thus, in the jig of FIGS. 1 through 20B, the block 66 is simply moved back into abutment with the stop 128, as described above, for this purpose. In the embodiment of FIG. 21, a stop (not shown) acting as an abutment for the clamp bar 304 serves the same purpose and in the embodiment of FIG. 22 the abutment surfaces 426 and 428 are fixed and therefore do not require readjustment.

It is also an advantage of the jig according to the present invention that it is simple to use, without requiring any special tools. The cutting region, at which the router bit cuts the workpiece, is fully enclosed in the jig housing, thus reducing the risk of injury to the user. The router is supported on the jig housing, and not on the pin and tail guide members, and is supported on both sides of the opening in the jig and therefore cannot tip. The safety glass plate allows the user to safely observe the router bit and the workpiece while protecting the user from flying wood waste and shattered router bit pieces. The pin and tail guide members can be positioned securely and incrementally and can readily be repositioned to provide precision repeatability.

In prior art jigs employing a removable finger assembly for guiding the router, there has been a risk that the finger assembly may be secured in a position which is not parallel to the workpiece. With the present jigs, however, the guide member supports are fixed to the jig housing and the clamp bars, and thus the workpiece, are maintained parallel to the guide member supports.

I claim:

1. A woodworking jig, comprising:

a pair of horizontally elongate co-planar router plate guide surface areas spaced apart from one another;

an elongate opening between said router plate guide surface areas;

a workpiece clamp mounted below said opening;

a guide member support extending along said opening; and a plurality of router guide members;

said router guide members and said router guide being releasably interengageable to locate said router guide members in operative positions above said workpiece clamp and below said router plate guide surfaces.

2. A woodworking jig as claimed in claim 1, wherein said clamp comprises a pair of horizontally closable clamp jaws, a clamp support arrangement carrying said clamp jaws and a clamp adjustment device operable to adjustably displace said clamp jaws horizontally to and fro in directions transverse to said elongate opening.

3. A woodworking jig as claimed in claim 1, wherein said guide member support has a row of locating formations distributed along said guide member support and said guide members have corresponding formations engageable with said locating formations on said guide member support.

4. A woodworking jig as claimed in claim 3, wherein said formations comprise interengageable teeth on said guide members and said guide member support.

5. A woodworking jig as claimed in claim 1, wherein said guide members are made of plastic material.

6. A woodworking jig as claimed in claim 1, wherein said guide members are resiliently engageable by a snap-action with said guide member support.

7. A woodworking jig as claimed in claim 1, wherein said guide members comprise dovetail pin guide members and dovetail tail guide members separate from said dovetail pin guide members.

8. A woodworking jig as claimed in claim 1, further comprising a vertically closable clamp positioned to clamp a horizontally extending workpiece below said operative positions of said guide members.

9. A woodworking jig as claimed in claim 8, including a safety plate extending downwardly in front of said vertically closable clamp, said plate being removable.

10. A woodworking jig as claimed in claim 9, wherein said safety closure plate is transparent.

11. A woodworking jig as claimed in claim 1, further comprising a housing containing said workpiece clamp, said housing having raised top portions extending along opposite sides of said elongate opening, and said router plate guide surface areas being formed on said raised top portions.

12. A woodworking jig as claimed in claim 11, further comprising a vertically closable clamp within said housing; a rear opening in said housing, said rear opening being horizontally aligned with said vertically closable clamp to enable a horizontal workpiece to be inserted through said rear opening into said vertically closable clamp.

13. A woodworking jig, comprising:

a clamp operable to hold a workpiece;

a guide member support above said clamp;

and a plurality of router guide members releasably mountable on said guide member support;

said guide member support having a plurality of locating formations distributed along said guide member support and said router guide members having corresponding formations which are interengageable with said locating formations on said guide member support, on mounting of said router guide members on said guide member support, to thereby retain said router guide members in position along said guide member support.

14. A woodworking jig as claimed in claim 13, wherein said locating formations are uniformly spaced in a linear row along said guide member support.

15. A woodworking jig as claimed in claim 13, wherein said clamp is a horizontally closable clamp for securing a vertically extending workpiece below said router guide members on said guide member support, and said jig further comprises a vertically closable clamp positioned to clamp an end of a horizontally extending workpiece below said router guide members on said guide member support.

16. A woodworking jig as claimed in claim 13, wherein said guide members comprise pin guides and tail guides which are separate from said pin guides.

17. A woodworking jig as claimed in claim 15, wherein said guide members comprise pin guides and tail guides separate from said pin guides.

18. A woodworking jig as claimed in claim 15, further comprising a jig body carrying said clamps and said guide member support, said jig body having a front opening through which a workpiece can be inserted into said vertically closable clamp and a movable closure for closing said front opening.

19. A woodworking jig as claimed in claim 18, wherein said housing includes a front opening, though which a workpiece can be inserted into said vertically closable clamp and a closure for said front opening, said closure being removable from said front opening.

20. A woodworking jig as claimed in claim 19, wherein said closure is removable from said jig body.

21. A woodworking jig as claimed in claim 19, wherein said movable closure is transparent.

22. A woodworking jig as claimed in claim 13, wherein said router guide members are releasably attachable to said guide member support by resilient snap-action interengagement with said guide member support.

23. A woodworking jig, comprising:

a router support for slidingly supporting a base plate of a router;

a router bit guide arrangement below said router support; and a workpiece clamping arrangement below said router bit guide arrangement;

said clamping arrangement comprising a horizontally closable clamp and a vertically closable clamp.

24. A woodworking jig as claimed in claim 23, wherein said horizontally closable clamp comprises a first elongate clamp member, an adjustment mechanism for adjustably displacing said first elongate clamp member horizontally to and fro, a second elongate clamp member parallel to and horizontally spaced from said first clamp member and a connection between said first and second clamp members, said connection being adjustable for adjustably displacing said clamp member to and fro relative to said first clamp member.

25. A woodworking jig as claimed in claim 24, wherein said adjustment mechanism comprises a pair of threaded shafts in threaded engagement with opposite ends of said first elongate clamp member, and a belt drive interconnecting said threaded shafts.

26. A woodworking jig as claimed in claim 24, wherein said connection comprises a pair of threaded shafts interconnecting opposite ends of said first and second elongate clamp members and in threaded engagement with one of said first and second clamp members, and a belt drive interconnecting said shafts.

27. A woodworking jig as claimed in claim 24, including an adjustable stop positioned for abutment with said first elongate clamp member.

28. A woodworking jig as claimed in claim 23, wherein said horizontally closable clamp comprises first and second elongate abutments which are horizontal and parallel to one another, an elongate clamp member extending parallel to said first and second elongate abutments, said clamping members being horizontally adjustably displaceable relative to said first and second elongate abutments between first and second clamping positions and having first and second clamping surfaces on opposite sides of said clamp member to enable clamping of a workpiece between said first clamping surface and said first elongate abutment member in the first clamping position and between said second clamping surface and said second elongate abutment in the second clamping position.

29. A woodworking jig as claimed in claim 28, including a support member, said second elongate abutment for adjustment movement to and fro relative to said first elongate abutment, said clamping arrangement including an adjustment device for effecting the adjustment movement.

30. A woodworking jig as claimed in claim 28, wherein said first and second elongate abutments each comprise a pair of elongate co-planar abutment surfaces spaced apart sufficiently to receive said clamp member therebetween.

31. A woodworking jig as claimed in claim 23, wherein said router bit guide arrangement comprises an elongate guide member support parallel to said first and second elongate abutments, and a plurality of router guide members, said guide member support and said router guide members being releasably interengageable to hold said router guide members in operative positions between said router support and said clamping arrangement.

32. A woodworking jig as claimed in claim 28, wherein said router bit guide arrangement comprises an elongate guide member support parallel to said first and second elongate abutments, and a plurality of router guide members, said guide member support and said router guide members being releasably interengageable to hold said router guide members in operative positions between said router support and said clamping arrangement.

33. A woodworking jig, comprising:

a router support for slidingly supporting the base plate of a router, said router support comprising a pair of horizontally elongate co-planar router plate guide surface areas spaced apart from one another;

an elongate opening between said router plate guide surface areas;

a workpiece clamp mounted below said opening;

a router bit guide arrangement below said router support, said router bit guide arrangement comprising a guide member support extending along said opening; and a plurality of router guide members mountable on said guide member support;

said router guide members and said router guide being releasably interengageable to locate said router guide members in operative positions above said workpiece clamp and below said router plate guide surfaces; and a workpiece clamping arrangement below said router guide arrangement, said workpiece clamping arrangement comprising a horizontally closable clamp and a vertically closable clamp, each operable to hold a workpiece:

said guide member support having a plurality of locating formations distributed along said guide member support and said router guide members having corresponding formations which are interengageable with said locating formations on said guide member support, on mounting of said router guide members on said guide member support, to thereby retain said router guide members in position along said guide member support.

* * * * *